US010065071B1

(12) United States Patent
Lorincz

(10) Patent No.: US 10,065,071 B1
(45) Date of Patent: Sep. 4, 2018

(54) EXERCISE CHAIR

(71) Applicant: Michal Lorincz, Bonita Springs, FL (US)

(72) Inventor: Michal Lorincz, Bonita Springs, FL (US)

( * ) Notice: Subject to any disclaimer, the term of this patent is extended or adjusted under 35 U.S.C. 154(b) by 0 days.

(21) Appl. No.: 15/603,682

(22) Filed: May 24, 2017

(51) Int. Cl.

| | |
|---|---|
| ***A63B 23/00*** | (2006.01) |
| ***A63B 23/02*** | (2006.01) |
| ***A63B 21/22*** | (2006.01) |
| ***A63B 21/00*** | (2006.01) |
| ***A47C 7/00*** | (2006.01) |
| ***A47C 7/02*** | (2006.01) |
| ***A47C 9/00*** | (2006.01) |

(52) U.S. Cl.
CPC ..... *A63B 23/0205* (2013.01); *A47C 7/004* (2013.01); *A47C 7/02* (2013.01); *A47C 9/002* (2013.01); *A63B 21/222* (2015.10); *A63B 21/4027* (2015.10)

(58) Field of Classification Search
CPC ..... A63B 23/0205; A63B 21/4027; A63B 21/222; A47C 9/002; A47C 7/02; A47C 7/004
USPC ..... 482/110; 297/313
See application file for complete search history.

(56) References Cited

U.S. PATENT DOCUMENTS

D223,113 S * 3/1972 King ..... 482/147
4,635,932 A * 1/1987 Dewees ..... A63B 22/18 482/146
4,946,160 A * 8/1990 Bertoletti ..... A63B 22/18 482/146
D325,608 S * 4/1992 Anderson ..... D21/690
6,428,451 B1 * 8/2002 Hall ..... A63B 22/18 482/146
7,614,698 B2 * 11/2009 Maier ..... A47C 1/022 297/313
7,686,396 B2 * 3/2010 Schaaf ..... A47C 7/14 297/313
7,708,675 B2 * 5/2010 Miskech ..... A63B 21/00181 482/140
7,803,096 B2 * 9/2010 Mehta ..... A63B 22/14 482/112
8,066,624 B1 * 11/2011 Stroup ..... A47C 9/002 297/338
8,439,442 B2 * 5/2013 Highlander ..... A47C 7/14 297/302.7
9,289,067 B2 * 3/2016 Meyer ..... A47C 7/14
(Continued)

*Primary Examiner* — Andrew S Lo
(74) *Attorney, Agent, or Firm* — Gulf Coast Intellectual Property Group

(57) ABSTRACT

An exercise chair that is operable to engage a user's core muscle groups in order to maintain a desired position thereof. The exercise chair includes a base having a plurality of legs. A seat member is rotatably secured to the base. A first mounting plate is secured to the bottom of the seat member. A second mounting plate is secured to the first mounting plate. The second mounting plate is ring-shaped and undulated in form having at least two peak section and at least two valley sections. A wheel assembly is superposed the base and includes wheels configured to engage the second mounting plate and traverse therealong. A mount having a shaft coupled thereto rotatably couples the seat member with the base. In a first position of the exercise chair, the wheels of the wheel assembly are engaged with the at least two peak sections.

19 Claims, 4 Drawing Sheets

(56) References Cited

U.S. PATENT DOCUMENTS

| | | | | |
|---|---|---|---|---|
| 2007/0007808 | A1* | 1/2007 | van Deursen | A47C 9/002 297/344.21 |
| 2007/0155603 | A1* | 7/2007 | Cook | A63B 22/18 482/142 |
| 2008/0079301 | A1* | 4/2008 | Schaaf | A47C 7/14 297/313 |
| 2009/0058156 | A1* | 3/2009 | Gang | A47C 3/0252 297/312 |
| 2010/0181815 | A1* | 7/2010 | Highlander | A47C 7/14 297/313 |
| 2011/0254240 | A1* | 10/2011 | Hurt | A47C 7/006 280/32.5 |
| 2012/0267923 | A1* | 10/2012 | Bouche | A47C 7/68 297/161 |
| 2013/0005550 | A1* | 1/2013 | Nagy | A47C 9/002 482/146 |
| 2014/0062153 | A1* | 3/2014 | Grove | A47C 3/0252 297/284.4 |
| 2016/0199687 | A1* | 7/2016 | Ho | A63B 23/0205 482/66 |
| 2017/0021230 | A1* | 1/2017 | Osler | A47C 9/002 |
| 2017/0087405 | A1* | 3/2017 | Walkama | A63B 22/14 |
| 2017/0290432 | A1* | 10/2017 | Reinhard | A47C 7/14 |

* cited by examiner

EXERCISE CHAIR

PRIORITY UNDER 35 U.S.C Section 119(e) & 37 C.F.R. Section 1.78

This nonprovisional application claims priority based upon the following prior United States Provisional Patent Application entitled: Ergonomic Exercise Chair, Application No.: 62/343,993 filed Jun. 1, 2016, in the name of Michal Lorincz, which is hereby incorporated by reference for all purposes.

FIELD OF THE INVENTION

The present invention relates generally to exercise devices, more specifically but not by way of limitation an exercise chair that is operable to facilitate the utilization of a user's core muscles wherein the chair requires a user to execute a rotational motion during use.

BACKGROUND

Millions of people suffer from low back pain. Low back pain can be chronic or brought about by an injury resulting from a particular activity. The treatments for low back pain range from muscle relaxers to physical therapy. During physical therapy, the emphasis is to begin to strengthen the core muscles in order to prevent low back pain. One issue with many people is the amount of time spent sitting at a desk. It is very common for people to sit at a desk for work for eight to ten hours per day. This time sitting in a chair contributes to the muscle degeneration as most chairs focus on ergonomic positioning but do not provide any muscle stimulation.

There are many devices that are available to assist a user in the development of their core muscles. As is known in the art, various sit-up machines and the like are available in gyms or can be purchased for home use. One issue with existing technology is the lack of integration of a chair that provides the functionality to provide a user a technique to exercise their core muscles while sitting at a desk. As such, those who spend hours every day at a desk typically suffer from low back pain as a results of the inactivity.

Accordingly, there is a need for an exercise chair that can be utilized at a desk wherein the exercise chair facilitates the development of the core muscles through requiring the user to perform a rotational movement in order to maintain the chair in a desired position.

SUMMARY OF THE INVENTION

It is the object of the present invention to provide an exercise chair that can be utilized at a desk wherein the chair facilitates the development of a user's core muscles that includes a base having a leg assembly.

Another object of the present invention is to provide an exercise chair that is operable to provide development of a user's core muscles that includes a wheel assembly superposed the leg assembly.

A further object of the present invention is to provide an exercise chair that can be utilized at a desk wherein the chair facilitates the development of a user's core muscles wherein the chair includes a seat member.

Still another object of the present invention is to provide an exercise chair that is operable to provide development of a user's core muscles wherein the seat member includes a first mounting plate secure to the bottom surface thereof.

An additional object of the present invention is to provide an exercise chair that can be utilized at a desk wherein the chair facilitates the development of a user's core muscles that further includes a second mounting plate secure to the first mounting plate opposite the seat member.

Yet a further object of the present invention is to provide an exercise chair that is operable to provide development of a user's core muscles wherein the second mounting plate is ring-shaped and is undulated.

Another object of the present invention is to provide an exercise chair that can be utilized at a desk wherein the chair facilitates the development of a user's core muscles wherein the second mounting plate is superposed the wheel assembly.

An alternative object of the present invention is to provide an exercise chair that is operable to provide development of a user's core muscles that further includes a shaft wherein the facilities rotational movement of the seat member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
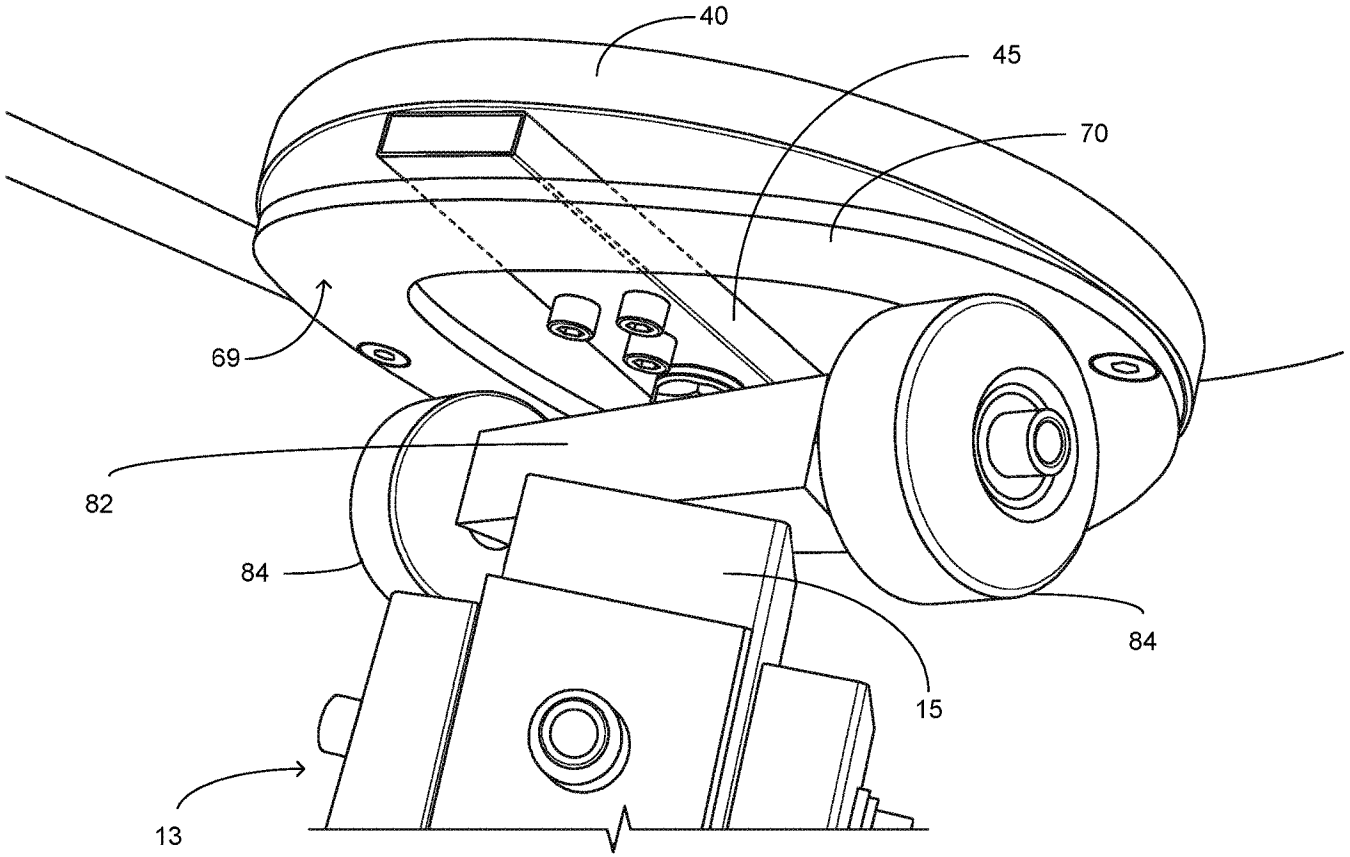
FIG. 1 is a bottom perspective view of the mounting plates and wheel assembly of the present invention.
Figure 2:
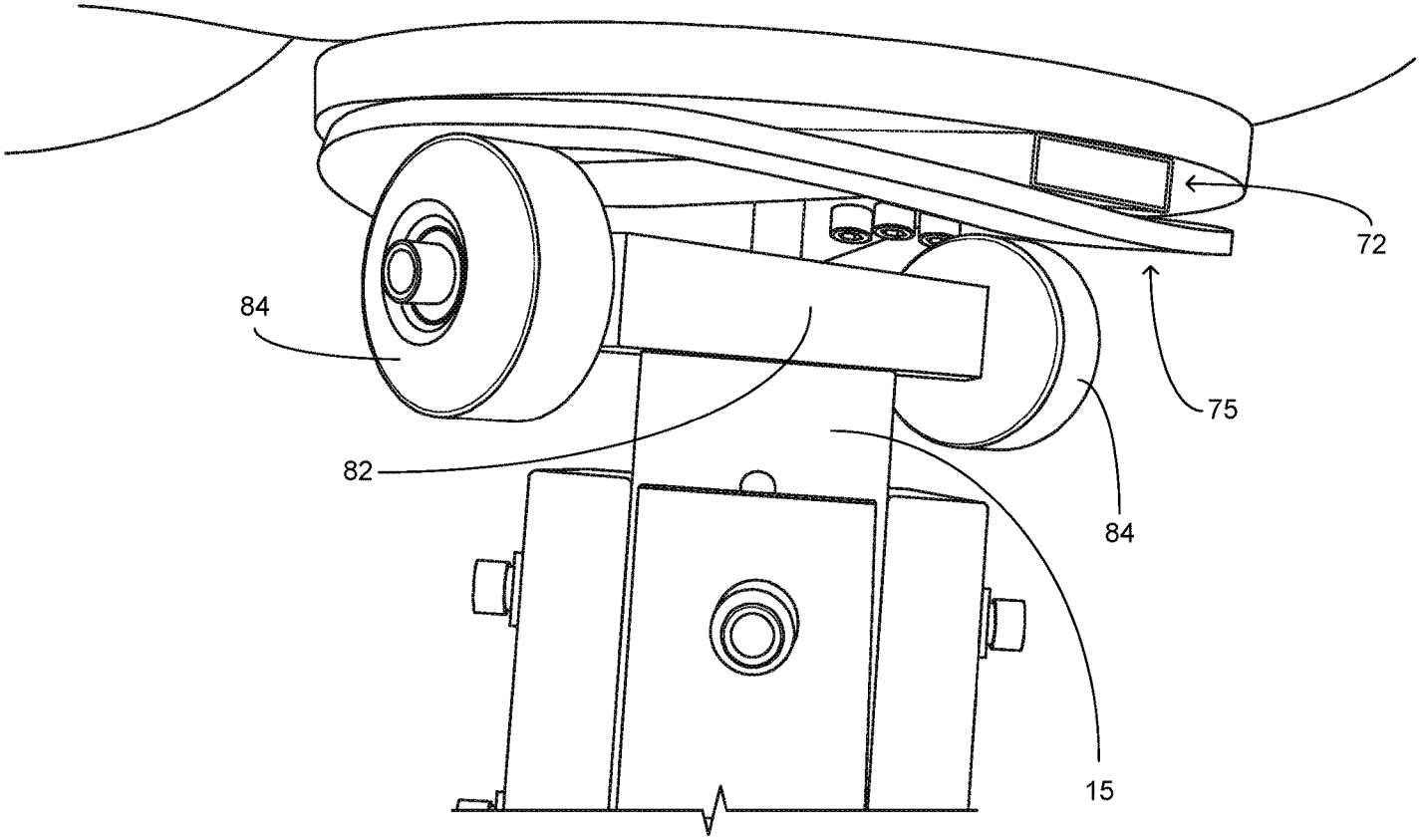
FIG. 2 is a side view of the mounting plates and wheel assembly.

Referring now to the drawings submitted herewith, wherein various elements depicted therein are not necessarily drawn to scale and wherein through the views and figures like elements are referenced with identical reference numerals, there is illustrated an exercise chair 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
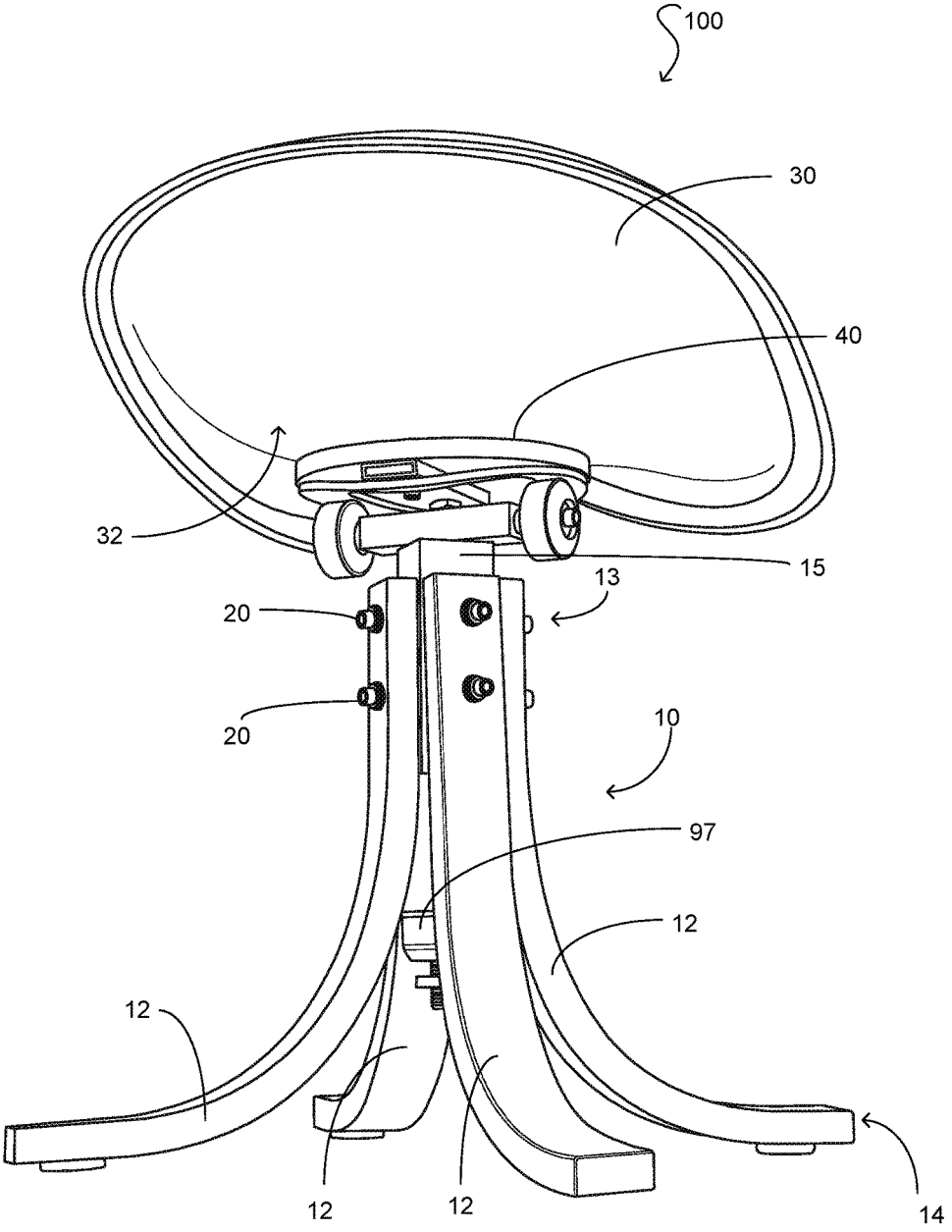
FIG. 3 is a perspective view of the present invention.
Figure 4:
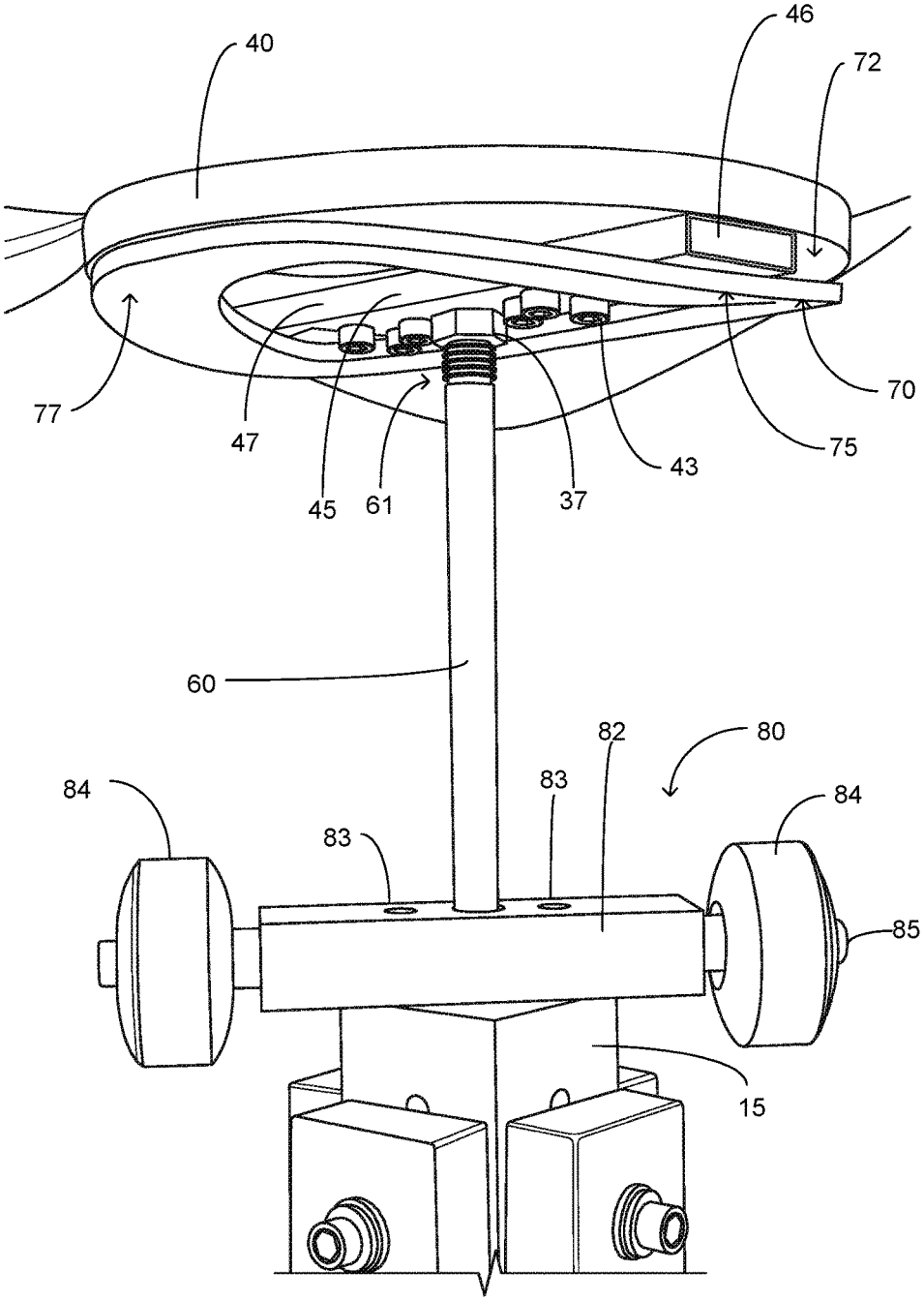
FIG. 4 is a detailed view of the shaft, wheel assembly and mounting plates of the present invention with the shaft partially removed from the leg assembly.

Referring in particular to FIG. 3 herein the exercise chair 100 includes base 10. Base 10 is configured to provide support for the exercise chair 100 so as to be superposed a suitable support surface such as but not limited to a floor. The base 10 of the present invention includes a plurality of legs 12 that include an upper end 13 and a lower end 14. The legs 14 are arcuate in shape proximate the lower end 14 so as to extend radially outward providing the necessary lateral support during use of the exercise chair 100. The legs 12 are secured to block 15 proximate the upper end 13 utilizing fasteners 20. Block 15 is disposed within the legs 12 providing a technique to secure the legs 12 in the desired position. The block 15 is manufactured from a suitable durable material such as but not limited to metal. While the legs 12 are disclosed herein as being formed in a particular shape, it is contemplated within the scope of the present invention that the legs 12 could be formed in alternate shapes. Furthermore, it is contemplated within the scope of the present invention that more or less than four legs 12 could be utilized for the base 10 and still achieve the desired objective described herein.

A seat member 30 is present and is superposed base 10 and is configured to be rotatably mounted thereto as will be further described herein. The seat member 30 is formed so as to accommodate a gluteus maximus of a human being and further a portion of the lower legs of a user. The seat member 30 is manufactured from a suitable durable material such as but not limited to plastic. It is contemplated within the scope of the present invention that the seat member 30 could be manufactured in numerous alternate shapes and/or sizes. Furthermore, while the seat member 30 herein is illustrated having no arm rests and/or back rests, it is contemplated within the scope of the present invention that the seat member 30 could be provided in alternative embodiments so as to include the aforementioned features.

Secured to the bottom 32 of the seat member 30 is first mounting plate 40. First mounting plate 40 is annular in shape and is secured to seat member 30 utilizing suitable durable techniques proximate the center thereof. The first mounting plate 40 is manufactured from a suitable durable material such as but not limited to metal. Secured to first mounting plate 40 opposite the bottom 32 of seat member 30 is mount 45. Mount 45 is a rectangular block secured to the first mounting plate 40 utilizing fasteners 43. Mount 45 provides a technique to operably couple the shaft 60 proximate upper end 61 thereof to the seat member 30 so as to provide the rotational functionality as will be further described herein. Mount 45 includes first end 46 and second end 47 that are configured to extended intermediate the first mounting plate 40 and second mounting plate 70, more specifically in the void 72 therebetween formed by the shape of the second mounting plate 70. First end 46 and second end 47 of mount 45 function to provide structural support for the second mounting plate 70 proximate the peak sections 75 thereof.

Seat member 30 is rotatably mounted on shaft 60. Shaft 60 is a conventional metal rod that is operably coupled to mount 45 utilizing keeper 37. Shaft 60 extends downward through block 15 into the base 10. Secured to shaft 60 distal to the mount 45 is support member 97. Support member 97 functions to engage the legs 12 in order to maintain the desired alignment of the shaft 60 in order to ensure rotational functionality thereof. It is contemplated within the scope of the present invention that the shaft 60 could be manufactured in alternate lengths in order to operably engage with a base 10 of an alternate design.

The second mounting plate 70 is ring-shaped and is secured to the first mounting plate 40 opposite seat member 30. The second mounting plate 70 is secured utilizing suitable durable techniques and is manufactured from a suitable durable material such as but not limited to metal. The second mounting plate 70 is formed in a specific undulated shape forming valley sections 77 and peak sections 75. The undulated shape of the second mounting plate 70 forms diametrically opposing peak sections 75 wherein the peak section 75 is distal to the first mounting plate 40 creating a void 72 therebetween. Circumferentially intermediate the peak sections 75 are the valley sections 77. The valley sections 77 are diametrically opposed and are adjacent the first mounting plate 40. As will be further described herein, the undulated shape is configured to engage the wheel assembly 80 and require a user of the exercise chair 100 to execute core rotational movements in either a clockwise or counter clockwise direction. The second mounting plate 70 is disclosed herein in its preferred embodiment wherein the second mounting plate 70 includes two valley sections 77 and two peak sections 75. It is further contemplated within the scope of the present invention that the second mounting plate 70 includes at least two peak sections 75 and two valley sections but alternative embodiments could include a larger quantity.

The wheel assembly 80 is superposed the upper end 13 of legs 12. Wheel assembly 80 includes member 82 which is secured to block 15 utilizing fasteners 83. Member 82 is perpendicularly mounted to the block 15 and block 15 has rotatably secured thereto on opposing ends wheels 84. Wheels 84 are rotatably mounted utilizing axle 85. As shown in FIG. 1 herein, the wheels 84 are configured to engage the lower surface 69 of the second mounting plate 70. The wheel assembly 80 provides the ability for a user to rotate the seat member 30 in either a clockwise or counterclockwise direction as the seat member 30 is rotatable on the shaft 60. As the wheels are positioned in diametrically opposing valley sections 77, gravitational forces maintain the seat member 30 in a consistent orientation. Subsequent the wheels 84 being located on opposing peak sections 75, a user must exert a rotational force in order to counter the gravitational forces attempting to traverse the wheels 84 to a naturally resting position in the peak sections 77. In order to maintain the wheels 84 on the peak section 75, a user must consistently exert a rotational force in alternating clockwise and counterclockwise direction thus providing a core muscle exercise for the user. While the wheel assembly 80 is illustrated herein as being superposed block 15, it is further contemplated within the scope of the present invention that the wheel assembly 80 could be into seat member 30 as an alternate configuration.

During use it is contemplated within the scope of the present invention that the base 10 could be oriented so as to position a user facing a desired object such as but not limited to a desk wherein the wheel assembly 80 is oriented so as to position the wheels 84 in the opposing valley sections 77 so as to allow a user of the chair to rest. Alternatively, when a user desires to engage their core muscles while sitting, the base 10 can be oriented towards an object wherein the wheels 84 are positioned at the apex of the diametrically opposed peak sections 75 and as such require consistent rotational force to maintain in either a clockwise or counterclockwise directions.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An exercise chair configured to promote utilization of a user's core muscles while superposed, the exercise chair comprising:

a base, said base including a plurality of legs, said base being configured to provide support for the exercise chair on a support surface;

a seat member, said seat member having an upper surface and a lower surface, said seat member being superposed said base distal to the support surface, said seat member being rotatably coupled to said base;

a first mounting plate, said first mounting plate being secured to said lower surface of said seat member;

a second mounting plate, said second mounting plate being operably coupled to said first mounting plate opposite said lower surface of said seat member, said second mounting plate being ring-shaped, said second mounting plate being undulated in form;

a wheel assembly, said wheel assembly having two wheels configured to engage said second mounting plate;

wherein a user of the exercise chair must exert either a counterclockwise or clockwise force in order to maintain the seat member in a desired position.

2. The exercise chair as recited in claim 1, and further including a mount, said mount being secured to said first mounting plate opposite said seat member, said mount having a first end and a second end, said mount having a shaft operably coupled thereto, said shaft configured to extend downward from said mount into said base.

3. The exercise chair as recited in claim 2, wherein said second mounting plate includes at least two peak sections, said at least two peak sections being diametrically opposed, said at least two peak section extending away from said first mounting plate.

4. The exercise chair as recited in claim 3, wherein said second mounting plate includes at least two valley sections, said at least two valley sections being diametrically opposed, said at least two valley sections being circumferentially intermediate said at least two peak sections, said at least two valley sections being adjacent said first mounting plate.

5. The exercise chair as recited in claim 4, and further including a block, said block being present on said base, said block being operably coupled to said wheel assembly.

6. The exercise chair as recited in claim 5, wherein said at least two peak sections of said second mounting plate form a void, said void being intermediate said second mounting plate and said first mounting plate.

7. An exercise chair configured to rotatably move wherein a user must provide a rotational force in order to maintain the chair in a desired position comprising:

a base, said base including a plurality of legs, said base having an upper end and a lower end, said plurality of legs extending radially outward, said base being configured to provide support for the exercise chair on a support surface;

a seat member, said seat member having an upper surface and a lower surface, said seat member being superposed said base distal to the support surface;

a first mounting plate, said first mounting plate being secured to said lower surface of said seat member, said first mounting plate being annular in shape;

a second mounting plate, said second mounting plate being operably coupled to said first mounting plate opposite said lower surface of said seat member, said second mounting plate being ring-shaped, said second mounting plate being undulated, said second mounting plate having at least two peak sections, said second mounting plate having at least two valley sections;

a wheel assembly, said wheel assembly including a block member being rectangular in shape, said wheel assembly being superposed said base, said wheel assembly having a first end and a second end, said wheel assembly having wheels rotatably coupled thereto at said first end and said second end; and wherein said seat member is rotatably secured to said base such that said wheels are operably engaged with said second mounting plate.

8. The exercise chair as recited in claim 7, and further including a mount, said mount being secured to said first mounting plate opposite said seat member, said mount having a first end and a second end, said mount having a shaft operably coupled thereto, said shaft having a first end and a second end, said first end being operably coupled to said mount, said second end of said shaft configured to extend downward into said base.

9. The exercise chair as recited in claim 8, wherein the at least two peak sections are diametrically opposed, said at least two peak section extending away from said first mounting plate and wherein in a first position said wheels are engaged with said at least two peak section requiring a rotational force to maintain position thereof.

10. The exercise chair as recited in claim 9, wherein the at least two valley sections of said second mounting plate are diametrically opposed, said at least two valley sections being circumferentially intermediate said at least two peak sections, said at least two valley sections being adjacent said first mounting plate.

11. The exercise chair as recited in claim 10, and further including a support member, said support member being operably coupled to said shaft proximate said second end, said support member configured to engage said plurality of legs of said base.

12. The exercise chair as recited in claim 11, wherein said at least two peak sections of said second mounting plate create a void, said void being intermediate said first mounting plate and said second mounting plate.

13. The exercise chair as recited in claim 12, wherein said first end and said second end of said mount extend into said void of said at least two peak sections.

14. An exercise chair operable to provide exercise of a user's core muscles through the requirement of a rotational force so as to maintain a desired position of the chair comprising:

a base, said base including a plurality of legs, said base having an upper end and a lower end, said plurality of legs extending radially outward, said base being configured to provide support for the exercise chair on a support surface;

a seat member, said seat member having an upper surface and a lower surface, said seat member being superposed said base distal to the support surface;

a first mounting plate, said first mounting plate being secured to said lower surface of said seat member, said first mounting plate being annular in shape;

a second mounting plate, said second mounting plate being operably coupled to said first mounting plate opposite said lower surface of said seat member, said second mounting plate being ring-shaped, said second mounting plate being undulated, said second mounting plate having at least two peak sections, said at least two peak sections being diametrically opposed on said second mounting plate, said second mounting plate having at least two valley sections, said at least two valley sections being diametrically opposed on said second mounting plate, said at least two valley sections being circumferentially intermediate said at least two peak sections;

a mount, said mount being secured to said first mounting plate opposite said seat member, said mount having a first end and a second end;

a wheel assembly, said wheel assembly including a block member being rectangular in shape, said wheel assembly being superposed said base, said wheel assembly having a first end and a second end, said wheel assembly having wheels rotatably coupled thereto at said first end and said second end; and wherein said wheels of said wheel assembly are engaged with said at least two peak sections in a first position and wherein an alternating rotational force applied by a user is required to maintain engagement of the wheels with the at least two peak sections.

15. The exercise chair as recited in claim 14, and further including a shaft operably coupled thereto, said shaft having a first end and a second end, said first end being operably coupled to said mount, said second end of said shaft configured to extend downward into said base.

16. The exercise chair as recited in claim 15, wherein said at least two peak sections of said second mounting plate create a void, said void being intermediate said first mounting plate and said second mounting plate.

17. The exercise chair as recited in claim 16, wherein said first end and said second end of said mount extend into said void of said at least two peak sections.

18. The exercise chair as recited in claim 17, and further including a support member, said support member being operably coupled to said shaft proximate said second end, said support member configured to engage said plurality of legs of said base.

19. The exercise chair as recited in claim 18, and further including a block, said block being secured to said base proximate said upper end thereof, said wheel assembly being superposed said block.

* * * * *